US010653198B2

(12) United States Patent
Skinner

(10) Patent No.: US 10,653,198 B2
(45) Date of Patent: May 19, 2020

(54) DEVICE FOR SHIELDING A USER FROM SUNLIGHT AND METHOD

(71) Applicant: Charles Skinner, Anthony, KS (US)

(72) Inventor: Charles Skinner, Anthony, KS (US)

( * ) Notice: Subject to any disclaimer, the term of this patent is extended or adjusted under 35 U.S.C. 154(b) by 0 days.

(21) Appl. No.: 16/139,588

(22) Filed: Sep. 24, 2018

(65) Prior Publication Data

US 2019/0142096 A1 May 16, 2019

Related U.S. Application Data

(60) Provisional application No. 62/586,819, filed on Nov. 15, 2017.

(51) Int. Cl.
*A42B 1/24* (2006.01)
*A42B 1/18* (2006.01)
*A42B 1/06* (2006.01)

(52) U.S. Cl.
CPC ..... *A42B 1/247* (2013.01); *A42B 1/061* (2013.01); *A42B 1/18* (2013.01)

(58) Field of Classification Search
CPC ..... A42B 1/244; A42B 1/242; A42B 1/205; A42B 1/24; A42B 1/18
USPC ..... 2/175.6
See application file for complete search history.

(56) References Cited

U.S. PATENT DOCUMENTS 1,228,341 A * 5/1917 Maynard ..... A42B 1/247 2/10
1,725,340 A * 8/1929 Castriotis ..... A42B 1/247 2/10
1,857,284 A * 5/1932 Nelson ..... A61F 9/025 2/10
2,434,076 A * 1/1948 Kilham ..... A42B 1/247 2/10
5,541,816 A * 7/1996 Miserendino ..... A42B 1/244 362/106
5,689,827 A * 11/1997 Ryder ..... A42B 1/247 2/10
6,170,084 B1 1/2001 Gordon et al.
6,237,147 B1 5/2001 Brockman
6,641,266 B1 11/2003 Lazarus
6,721,962 B1 * 4/2004 Polaire ..... A42B 1/244 2/209.13
9,078,483 B1 7/2015 Snyder
2004/0093654 A1 5/2004 Hanrahan et al.
2009/0235437 A1 * 9/2009 Springer ..... A42B 3/185 2/422
2010/0257659 A1 * 10/2010 Hitch ..... A42B 1/18 2/424
2014/0270685 A1 * 9/2014 Letke ..... A42B 1/244 386/224
2014/0338107 A1 11/2014 McGahey
(Continued)

*Primary Examiner* — Gloria M Hale
(74) *Attorney, Agent, or Firm* — Charles Runyan

(57) ABSTRACT

A device for shielding a user from sunlight is disclosed herein. The device includes a clip portion, a shade portion, a connector piece, and an illuminating source located on an upper surface of the shade portion. The clip portion includes an elongate body, an upper side, and a lower side. The shade portion is adjustably coupled to the clip portion by the connector piece. The device is useful for providing a removable shade for connection with a brim of a hat that allows a user to adjust the shade in multiple directions to keep sunlight out of the user's eyes.

19 Claims, 5 Drawing Sheets

(56) References Cited

U.S. PATENT DOCUMENTS

| | | | | |
|---|---|---|---|---|
| 2015/0164168 | A1* | 6/2015 | Polifroni | A42B 1/247<br>2/209.13 |
| 2017/0245574 | A1* | 8/2017 | Danko | A42B 1/064 |

* cited by examiner

DEVICE FOR SHIELDING A USER FROM SUNLIGHT AND METHOD

CROSS-REFERENCE TO RELATED APPLICATION(S)

The present application is related to and claims priority to U.S. Provisional Patent Application No. 62/586,819 filed Nov. 15, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is explicitly or implicitly referenced is prior art.

TECHNICAL FIELD

The present invention relates generally to the field of headwear of existing art and more specifically relates to eye shielding devices.

RELATED ART

Many people spend as much time outside as possible, whether simply enjoying nice weather, swimming, watching or playing sports, hiking, hunting, golfing, biking, jogging, camping, hanging out with a group of friends, and much more. Unfortunately, the sun's harsh rays may not only cause temporary blindness, but prolonged exposure may also damage the eyes, even when wearing a hat. Additionally, hats do not block all the sunlight from shining into a person's face. A suitable solution is desired.

U.S. Pat. No. 6,237,147 to Robert Brockman relates to lateral sun shields conformed for selective attachment to a baseball cap visor or brim. The described lateral sun shields conformed for selective attachment to a baseball cap visor or brim includes an eye shield assembly useful for selective attachment to the visor of a baseball cap for providing lateral shielding from direct or reflected glare includes, in its first preferred implementation, an elongate planar shielding surface defined by a forward and rearward end and an upper and lower edge. A front and rear attachment extend from the upper edge for selective engagement to the visor edge and the cap, with the shielding alignment further determined by a planar projection extending beyond the upper edge, intermediate the front and rear attachments, conformed for captured receipt between the cap and the skull of the wearer. The attachments may take the form of tined structures flexibly secured to the shielding surface to effect attachment along either side of the cap or may take the form of convolved strips conformed for selective receipt of the cap edges in selected convolutions. In the second implementation an extruded structure, including a split tube attached to a planar ribbon, is die cut to form the shielding surface with the split tube segments providing selective engagement to the cap.

SUMMARY OF THE INVENTION

Given the foregoing disadvantages inherent in the known eye-shielding-device art, the present disclosure provides a novel device for shielding a user from sunlight. The general purpose of the present disclosure, which will be described subsequently in greater detail, is to provide a shade having an adjustable clip for attachment to the brim of a hat.

A device for shielding a user from sunlight is disclosed. The device includes a clip portion, a shade portion, a connector piece, and an illuminating source located on an upper surface of the shade portion. The clip portion may include an elongate body, an upper side, and a lower side. The shade portion may be adjustably coupled to the clip portion by the connector piece. The device may be useful for providing a removable shade for connection with a brim of a hat that allows a user to adjust the shade in multiple directions to keep sunlight out of the user's eyes.

According to another embodiment, a method of shielding a user from sunlight is also disclosed. The method of shielding a user from sunlight includes providing a device for shielding a user from sunlight, clipping the device on a brim of a hat, and adjusting the shade portion of the device to block direct sunlight.

For purposes of summarizing the invention, certain aspects, advantages, and novel features of the invention have been described. Not necessarily all such advantages may be achieved by any one particular embodiment of the invention. Thus, the invention may be embodied or carried out in a manner that achieves or optimizes one advantage or group of advantages without necessarily achieving other advantages as may be taught or suggested. The features of the invention that are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a device for shielding a user from sunlight and method, constructed and operative according to the teachings of the present disclosure.

The various embodiments of the present invention will be described in conjunction with the appended drawings, in which like designations denote like elements.

DETAILED DESCRIPTION

As discussed above, embodiments of the present disclosure relate to an eye-shielding device and more particularly to a device for shielding a user from sunlight by providing a shade having an adjustable clip for attachment to the brim of a hat.

Generally, the object of this disclosure provides a device that protects the eyes of a user from the sun's harsh rays when wearing a baseball cap. The device may clip onto a cap's bill and adjust up, down, or side-to-side. The device may also telescope outwards away from the user. This multi-directional adjustment means, adjusted to the down position, may help to block the sunlight. This device may further prevent eyestrain, sun damage to the eyes, and temporary loss of vision or blurred vision. Additionally, the device may include an LED light for enhanced visibility in dark or lowlight conditions.

The present device may comprise a solid shade in a variety of shapes, made from moldable plastic or other suitable material, measuring approximately 1.5" in height and 7" in length. Additionally, the shade may be hinged to a clip that can slide onto the brim of a hat. The front of the shade can be outfitted with a company logo for marketing purposes. Further, the plastic shade can be adjusted up, down, or side-to-side, and can telescope outward. The shade can also rotate from a horizontal position, extending the length of the hat bill, to a vertical position, stowing it out of the way. On the top of the shade, the included light may be depressed to engage a beam of light. The exact specifications may vary upon manufacturing.

Upon reading this specification, it should be appreciated that, under appropriate circumstances, considering such issues as user preferences, design preference, structural requirements, marketing preferences, cost, available materials, technological advances, etc., other hat shade arrangements such as, for example, varying shade dimensions and shapes, etc., may be sufficient.

Referring now more specifically to the drawings by numerals of reference, there is shown in FIGS. 1-4, various views of a device 100 for shielding a user from sunlight.

Figure 1:
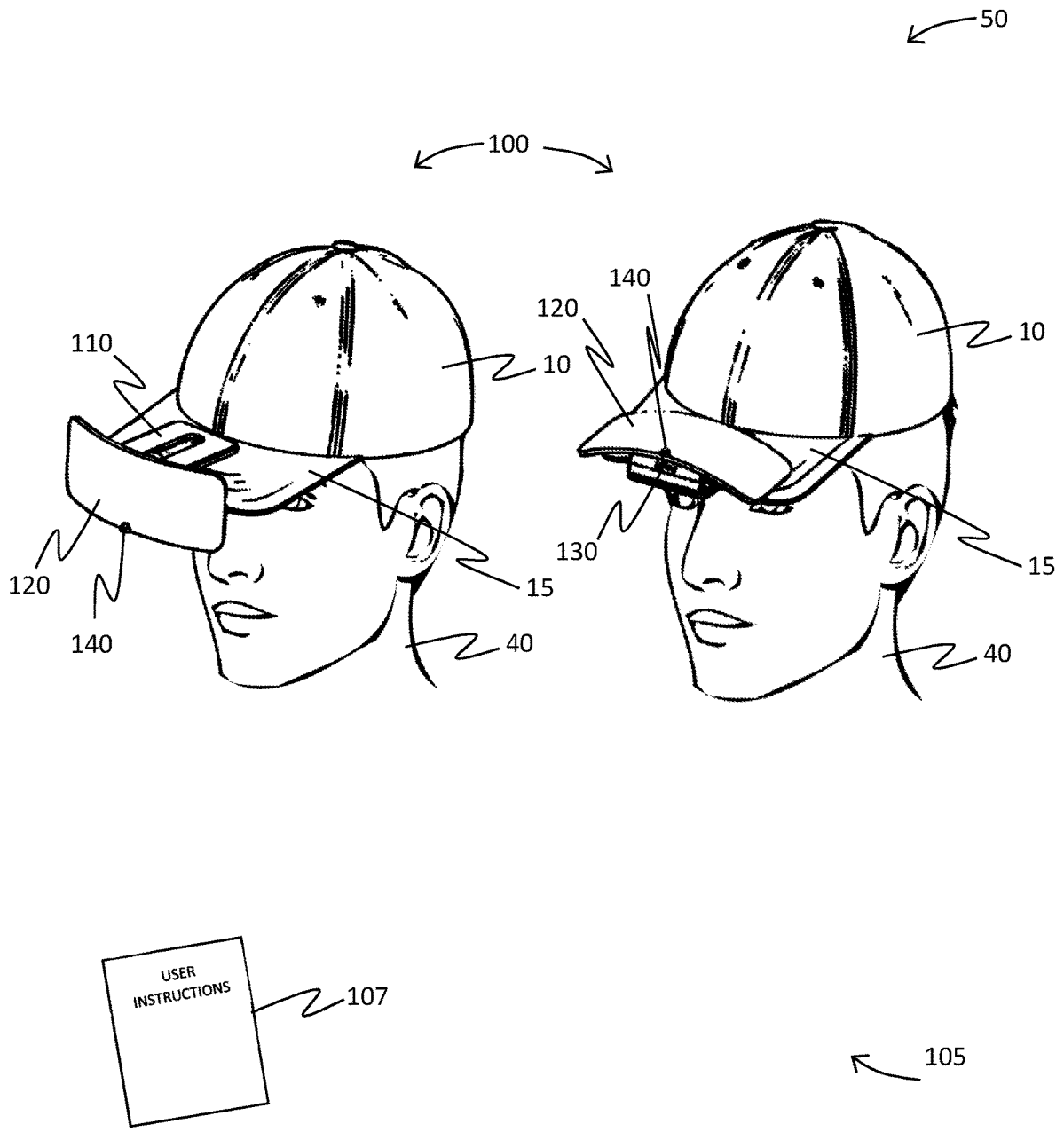
FIG. 1 is a perspective view of the device for shielding a user from sunlight during an 'in-use' condition, according to an embodiment of the disclosure.

FIG. 1 shows a device 100 for shielding a user from sunlight during an 'in-use' condition 50, according to an embodiment of the present disclosure. Here, the device 100 may be beneficial for use by a user 40 to provide a shade having an adjustable clip for attachment to the brim 15 of a hat 10. As illustrated, the device 100 for shielding a user from sunlight may include a clip portion 110, a shade portion 120, a connector piece 130, and an illuminating source 140. The connector piece 130 may be configured to adjustably couple the shade portion 120 to the clip portion 110. The illuminating source 140 may be located on said shade portion 120.

According to one embodiment, the device 100 for shielding a user from sunlight may be arranged as a kit 105. In particular, the device 100 may further include a set of instructions 107. The instructions 107 may detail functional relationships in relation to the structure of the device 100 such that the device 100 for shielding a user from sunlight can be used, maintained, or the like, in a preferred manner.

Figure 2:
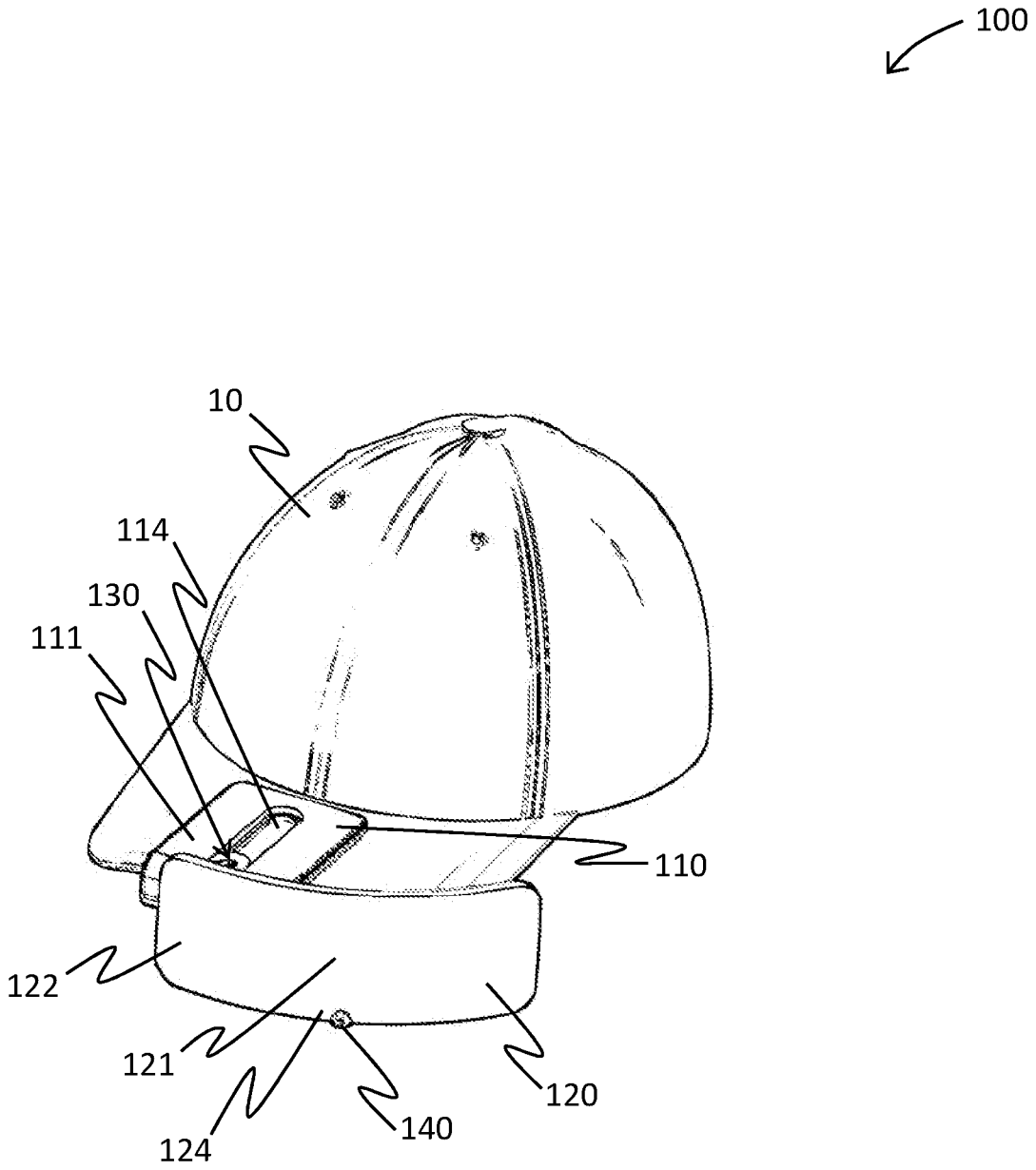
FIG. 2 is a top perspective view of the device of FIG. 1 for shielding a user from sunlight, according to an embodiment of the present disclosure.

FIG. 2 shows the device 100 of FIG. 1 for shielding a user from the sunlight, according to an embodiment of the present disclosure. As above, the device 100 may include a clip portion 110 having a clip elongate body 111 for connecting the device 100 to the brim 15 of a hat 10, a shade portion 120 made of a plastic material, a connector piece 130, and an illuminating source 140. The connector piece 130 may be configured to adjustably couple the shade portion 120 to the clip portion 110. The illuminating source 140 may be located on said shade portion 120. The clip portion 110 may have an aperture 114 configured to receive the connector piece 130. Also, the shade portion 120 may have a shade elongate body 121 and an upper surface 122. The illuminating source 140 may be located in a center portion 124 of the upper surface 122 of the shade portion 120.

Figure 3:
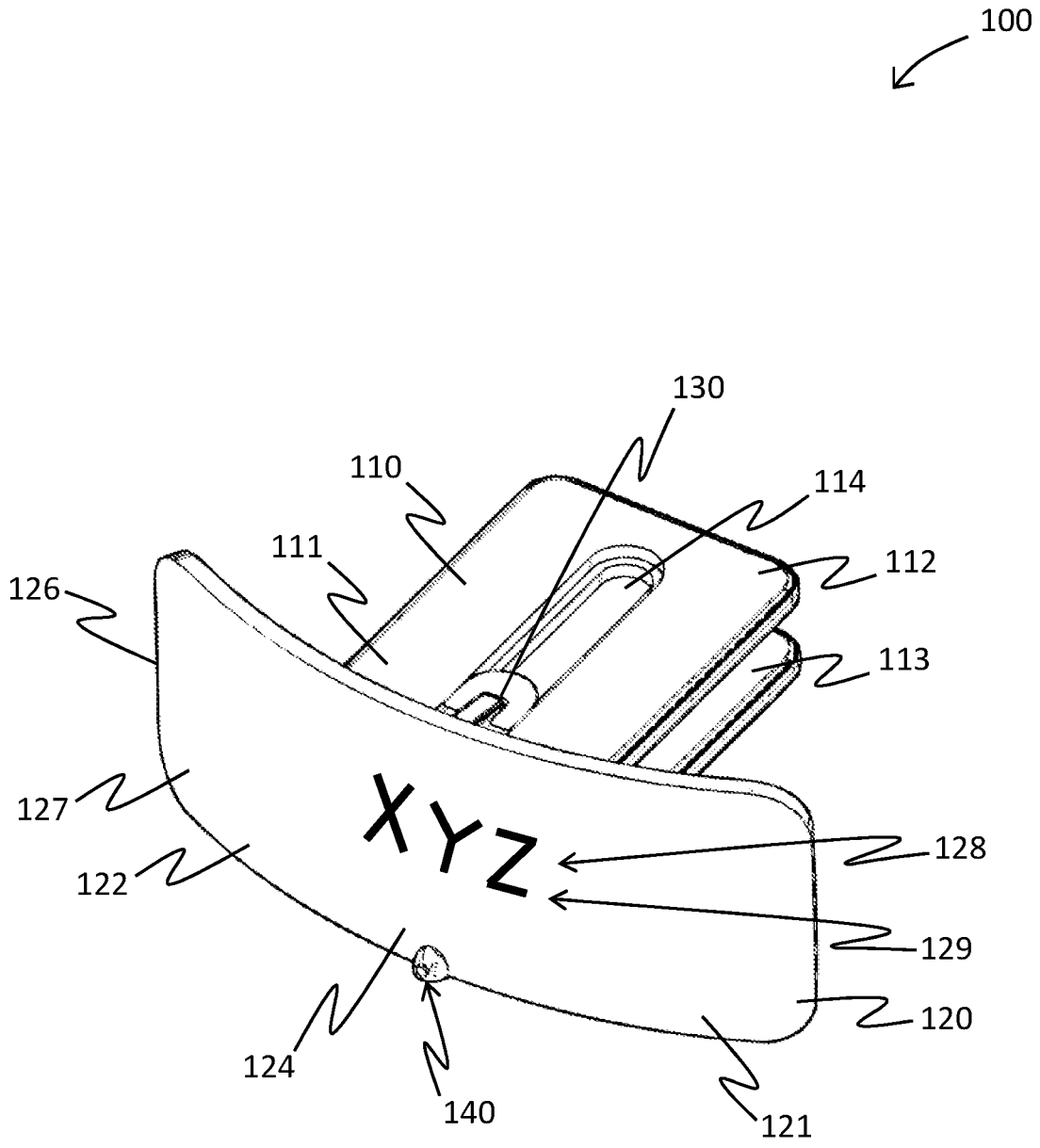
FIG. 3 is another top perspective view of the device of FIG. 1, according to an embodiment of the present disclosure.

FIG. 3 is a top perspective view of the device 100 of FIG. 1 for shielding a user from sunlight, according to an embodiment of the present disclosure. Here again, the device 100 may include a clip portion 110 having a clip elongate body 111 an upper side 112 and a lower side 113. The device may also include a shade portion 120 made of a plastic material, a connector piece 130, and an illuminating source 140. The connector piece 130 may be configured to adjustably couple the shade portion 120 to the clip portion 110. The illuminating source 140 may be located on the shade portion 120. The clip portion 110 may have an aperture 114 configured to receive the connector piece 130. Also, the shade portion 120 may have a shade elongate body 121 and may have an upper surface 122 that includes a design 128, which may include a logo 129. The illuminating source 140 may be located in a center portion 124 of the upper surface 122 of the shade portion 120. The shade portion 120 may further be configured to rotate to a vertical second position 126.

Figure 4:
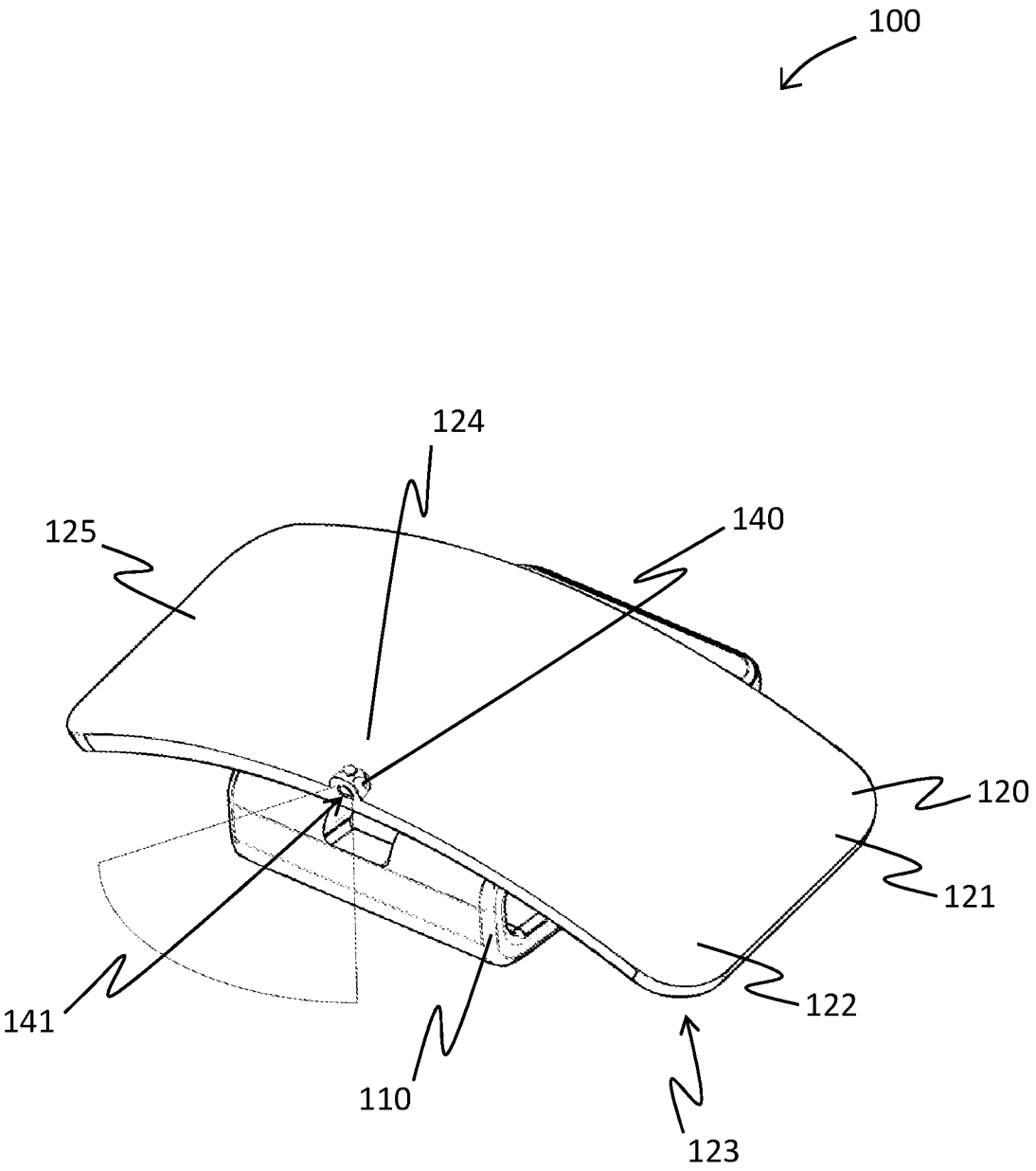
FIG. 4 is an additional perspective view of the device of FIG. 1 showing the adjustable shade positioned upwards to expose the illuminating source, according to an embodiment of the present disclosure.

FIG. 4 is a perspective view of the device 100 of FIG. 1 for shielding a user from the sunlight, according to an embodiment of the present disclosure. As above, the device 100 may include a clip portion 110, a shade portion 120, and an illuminating source 140. The shade portion 120 may have a shade elongate body 121, an upper surface 122, a lower surface 123, and a center portion 124. The shade portion 120 may be configured to be adjustably coupled to the clip portion 110. The shade portion 120 may be configured to rotate from a horizontal first position, as shown in FIGS. 1 and 4, to a vertical second position, as shown in FIGS. 1 and 3. The illuminating source 140 may comprise a light emitting diode 141.

Figure 5:
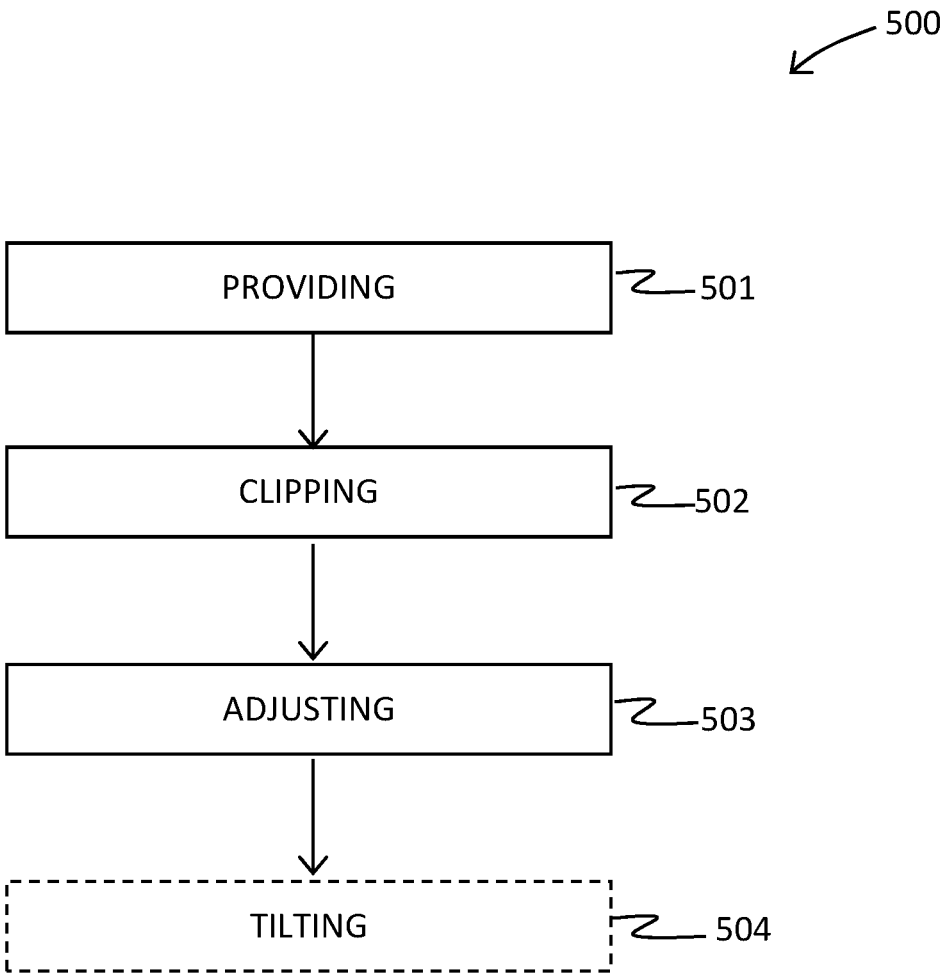
FIG. 5 is a flow diagram illustrating a method of shielding a user from sunlight, according to an embodiment of the present disclosure.

FIG. 5 is a flow diagram illustrating a method 500 of shielding a user from sunlight, according to an embodiment of the present disclosure. In particular, the method 500 of shielding a user from sunlight may include one or more components or features of the device 100 for shielding a user from sunlight as described above. As illustrated, the method 500 of shielding a user from sunlight may include the steps of step one 501, providing a device for shielding a user from sunlight, said device comprising a clip portion, said clip portion having a clip elongate body, an upper side and a lower side, a shade portion, said shade portion having a shade elongate body, an upper surface and a lower surface and wherein said shade portion is adjustably coupled to said clip portion, a connector piece, said connector piece configured to adjustably couple said shade portion to said clip portion, an illuminating source, said illuminating source located on said upper surface of said shade portion; step two 502, clipping said device on a brim of a hat; step three 503, adjusting said shade portion to block direct sunlight.

It should be noted that step four 504, tilting said shade portion in multiple positions, is an optional step and may not be implemented in all cases. Optional steps of the method of use 500 are illustrated using dotted lines in FIG. 5 to distinguish them from the other steps of the method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for the device for shielding a user from sunlight, are taught herein.

The embodiments of the invention described herein are exemplary, and numerous modifications, variations, and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A device comprising:

a clip portion having a clip elongate body, an upper side, and a lower side;

a shade portion having a shade elongate body, an upper surface, and a lower surface wherein the shade portion couples to the clip portion with an adjustable connector piece;

and an illuminating source located on the upper surface, wherein the clip portion clips on a brim of a hat and shield a user from sunlight.

2. The device of claim 1 wherein the illuminating source is a light emitting diode.

3. The device of claim 1 wherein the illuminating source sits at a center portion of the upper surface.

4. The device of claim 1 wherein the clip portion has an aperture configured to receive the connector piece.

5. The device of claim 1 wherein the shade portion mounts on an adjustable portion that tilts upwards.

6. The device of claim 1 wherein the shade portion mounts on an adjustable portion that tilts upwards.

7. The device of claim 1 wherein the shade portion mounts on an adjustable portion that tilts upwards.

8. The device of claim 1 wherein the shade portion mounts on an adjustable portion that tilts upwards.

9. The device of claim 1 wherein the shade portion is configured to slide outwardly from the clip portion.

10. The device of claim 1 wherein the shade portion is configured to rotate from a horizontal first position to a vertical second position.

11. The device of claim 1 wherein the shade portion is made of a plastic material.

12. The device of claim 1 wherein the shade portion is approximately 1.5" in height.

13. The device of claim 1 wherein the shade portion is approximately 7" in length.

14. The device of claim 1 wherein the upper surface includes a design.

15. The device of claim 14 wherein the design includes a logo.

16. A device comprising:

a clip portion having a clip elongate body, an upper side, and a lower side;

a shade portion having a shade elongate body, an upper surface, and a lower surface wherein the shade portion couples to the clip portion with an adjustable connector piece;

and an illuminating source located on the upper surface, wherein the illuminating source is a light emitting diode and sits in a center portion of the upper surface, the clip portion has an aperture that is configured to receive the connector piece, the shade portion mounts on an adjustable portion that tilts upwards, downwards, leftward, rightward, slides outwardly from the clip portion, and rotates from a horizontal first position to a vertical second position, the shade portion is made of a plastic material and is approximately 1.5" in height by approximately 7" in length, the upper surface includes a design including a logo, the clip portion clips on a brim of a hat, and the device is configured to shield a user from sunlight.

17. The device of claim 16 further comprising a set of instructions wherein the device and instructions are arranged as a kit.

18. A method comprising:

providing a device comprising:

a clip portion having an elongate body, an upper side, and a lower side;

a shade portion having an elongate body, an upper surface, and a lower surface wherein the shade portion couples to the clip portion with an adjustable connector piece;

and an illuminating source sitting on the upper surface;

clipping the device on a brim of a hat; and adjusting the shade portion to block direct sunlight.

19. The method of claim 18 wherein adjusting the shade portion to block direct sunlight includes tilting the shade portion.

* * * * *